US008959966B2

(12) United States Patent
Clark et al.

(10) Patent No.: US 8,959,966 B2
(45) Date of Patent: Feb. 24, 2015

(54) MAGNETIC GATE LATCH

(75) Inventors: Anthony John Clark, Cremorne (AU); Linn Thu Yein Tun, Baulkham Hills (AU); Justin Alexander, Victoria (CA)

(73) Assignee: D & D Group Pty. Ltd., Frenchs Forest (AU)

( * ) Notice: Subject to any disclaimer, the term of this patent is extended or adjusted under 35 U.S.C. 154(b) by 292 days.

(21) Appl. No.: 13/579,102

(22) PCT Filed: Feb. 4, 2011

(86) PCT No.: PCT/AU2011/000113

§ 371 (c)(1), (2), (4) Date: Oct. 10, 2012

(87) PCT Pub. No.: WO2011/100782

PCT Pub. Date: Aug. 25, 2011

(65) Prior Publication Data

US 2013/0031942 A1 Feb. 7, 2013

Related U.S. Application Data

(60) Provisional application No. 61/305,032, filed on Feb. 16, 2010.

(51) Int. Cl.

| | |
|---|---|
| ***E05B 47/00*** | (2006.01) |
| ***E05B 65/00*** | (2006.01) |
| ***E05B 1/00*** | (2006.01) |
| ***E05B 13/10*** | (2006.01) |
| ***E05B 15/02*** | (2006.01) |
| ***E05B 15/10*** | (2006.01) |
| ***E05B 63/22*** | (2006.01) |
| ***E05C 1/06*** | (2006.01) |
| ***E05C 19/16*** | (2006.01) |
| *E05B 9/08* | (2006.01) |
| *E05B 15/16* | (2006.01) |
| *E05B 53/00* | (2006.01) |

(52) U.S. Cl.

CPC ..... *E05B 65/0007* (2013.01); *E05B 1/0038* (2013.01); *E05B 13/101* (2013.01); *E05B 13/105* (2013.01); *E05B 15/025* (2013.01); *E05B 15/101* (2013.01); *E05B 63/22* (2013.01); *E05C 1/06* (2013.01); *E05C 19/163* (2013.01); *E05B 9/086* (2013.01); *E05B 15/1635* (2013.01); *E05B 53/00* (2013.01)

USPC ..... 70/276; 292/251.5

(58) Field of Classification Search

USPC ..... 70/276; 292/251.5

See application file for complete search history.

(56) References Cited

U.S. PATENT DOCUMENTS

| | | | | |
|---|---|---|---|---|
| 2,586,900 | A * | 2/1952 | Alderman | 292/74 |
| 2,808,281 | A * | 10/1957 | Poe | 292/251.5 |
| 2,942,907 | A * | 6/1960 | Nagel et al. | 292/251.5 |

(Continued)

FOREIGN PATENT DOCUMENTS

| | | | |
|---|---|---|---|
| AU | 76138/91 | B | 6/1994 |
| CN | 1376231 | A | 10/2002 |
| CN | 1661189 | A | 8/2005 |

*Primary Examiner* — Suzanne Barrett

(74) *Attorney, Agent, or Firm* — Kelly & Kelley, LLP

(57) ABSTRACT

A latch has a magnet in one unit and an attracted element (e.g. ferromagnetic structure or another magnet) in second unit with a latching mechanism which operate under magnetic attraction. The latch has an actuator connected to a linkage to cause displacement of the magnet or the attracted element in a direction substantially normal to the axis of pivoting.

19 Claims, 20 Drawing Sheets

(56) References Cited

U.S. PATENT DOCUMENTS

| | | | | | |
|---|---|---|---|---|---|
| 3,066,964 | A * | 12/1962 | Lemaire | 292/173 |
| 3,069,193 | A * | 12/1962 | Kirk | 292/144 |
| 3,350,127 | A * | 10/1967 | Hekelaar | 292/251.5 |
| 5,362,116 | A * | 11/1994 | Doyle et al. | 292/144 |
| 7,044,511 | B2 * | 5/2006 | Kliefoth et al. | 292/251.5 |
| 7,390,035 | B2 * | 6/2008 | Karcz et al. | 292/163 |
| 7,766,399 | B2 * | 8/2010 | Howey | 292/251.5 |
| 8,256,806 | B2 * | 9/2012 | Timothy | 292/251.5 |
| 8,376,421 | B2 * | 2/2013 | Simmonds | 292/251.5 |
| 8,393,653 | B2 * | 3/2013 | Clark | 292/251.5 |
| 8,505,989 | B2 * | 8/2013 | Wells | 292/251.5 |
| 2005/0184532 | A1 | 8/2005 | Karcz et al. | |
| 2005/0199025 | A1 | 9/2005 | West | |
| 2005/0225098 | A1 | 10/2005 | Kliefoth et al. | |
| 2006/0103142 | A1 | 5/2006 | Talpe | |
| 2008/0141742 | A1 * | 6/2008 | Stuckey | 70/224 |
| 2012/0240474 | A1 * | 9/2012 | Purssey | 49/506 |

* cited by examiner

MAGNETIC GATE LATCH

FIELD OF THE INVENTION

The present invention relates to latches and particularly but not exclusively to a magnetic latch for a swinging barrier such as a gate or a door.

BACKGROUND OF THE INVENTION

Latches for swinging barriers, such as gates and doors, generally provide security and safety. Some latches, however, fail to close properly because the latch mechanism is resistant to closing. For example, if a gate is gently swung towards a closed position, the gate may not have enough momentum to work the latch mechanism causing latching failure. In some circumstances the latch jams up or sticks.

SUMMARY OF THE INVENTION

In a first aspect, the invention provides a latch for a swinging barrier, the latch comprising:

first and second units adapted for mounting respectively on the swinging barrier and an adjacent structure, one of the units having a first magnet and the other having an element magnetically attracted to the first magnet, such that when the first and second units are brought together a magnetic force from the magnetic attraction between the element and first magnet causes a relative displacement of a latch member associated with one of the units into a latch receiver associated with the other unit;

a biasing member arranged to bias at least one of the first magnet and the element away from the other with a force less than the magnetic force;

an actuator for displacing one of the first magnet and the element and comprising a lever arm mounted to pivot around an axis and arranged to cause displacement of one of the magnet and the element in a direction substantially normal to the axis.

For at least one embodiment of the latch, in use one of the units is mounted on the swinging barrier, such as a door or gate, and the other is mounted on the adjacent structure, such as a door jamb or gate post. When the barrier is open the magnetic attraction is weak and the latch member and the latch receiver are relatively displaced by the biasing member. The element thus clears the latch receiver when the barrier is moved into closure. When the barrier is closed the magnetic attraction is relatively strong causing the relative displacement of the latch member into the latch receiver, securing the barrier.

In an embodiment, the magnetic force pulls the latch member towards the latch receiver. The latch receiver may have the first magnet.

In an embodiment, the element may have a second magnet orientated to be attracted to the first magnet.

In an embodiment, the lever arm is coupled to a rotary to linear linkage, for example a bell crank, arranged to displace a mounting arm on which one of the latch member and the latch receiver is mounted. The mounting arm may be biased in a direction and the linkage is arranged to displace the mounting arm in an opposite direction.

In an embodiment, the actuator may further comprise a push-button.

In an embodiment, the latch comprises a lock. The lock may be adapted to, when operated, decouple the linkage from the mounting arm. The linkage may be biased to couple with the mounting arm. The lock may be coupled to a cam wherein operation of the lock causes the cam to rotate and lift the linkage out of alignment with the mounting arm. The lock may be coupled to the cam by a shaft. A pin may couple the cam and the linkage, the pin being displaced by rotation of the cam which in turn lifts the linkage. In an alternative embodiment, the latch comprises a lock operationally coupled to a rotor. The rotor has a rotor arm that is rotated by operation of the lock. The latch may have a rotor arm cavity into which the rotor may move when the lock is in an unlocked position. The latch may have an interfering member which blocks a movement of the rotor arm when the lock is in a locked position.

In an embodiment, the latch member comprises a rotatable bearing, for example a rotatable sleeve.

In an embodiment, the latch comprises a wing extending outwardly. The wing may comprise a thumb receiving portion. The lever arm may have an end adjacent the wing and extending perpendicularly to the wing. The latch may be configured so that a thumb of a hand is placed on the thumb receiving portion and at least one finger of the hand placed behind the end of the lever arm. An opposing force may be applied by the hand to each of the end and wing respectively for operating the latch.

In an embodiment, the lever arm may be adapted to be pushed. Alternatively or additionally, the lever arm may be adapted to be pulled.

This form of latch may be especially useful for gates such as double gates and a pull-arm can be linked to a push arm on the other side of the gate. Locking may be provided on either or both sides of the gate.

In a second aspect, the invention provides a latch for a swinging barrier, the latch comprising:

first and second units adapted for mounting respectively on the swinging barrier and an adjacent structure, one of the units having a first magnet and the other having an element magnetically attracted to the first magnet, such that when the first and second units are brought together a magnetic force from the magnetic attraction between the element and first magnet causes a relative displacement of a latch member associated with one of the units into a latch receiver associated with the other unit;

a biasing member arranged to bias at least one of the first magnet and the element away from the other with a force less than the magnetic force;

an actuator adapted to move the first magnet and the element relatively apart along a displacement axis, the actuator comprising an interface member adapted to be moved by a hand in a direction transverse to the displacement axis.

In an embodiment, the actuator comprises a linkage, for example a bell crank, adapted to translate the movement of the interface member in the transverse direction to a movement along the displacement axis.

In a third aspect, the invention provides a latch for a swinging barrier, the latch comprising:

first and second units adapted for mounting respectively on the swinging barrier and an adjacent structure;

a latch member coupled to one of the units, the latch member having an axis;

a latch receiver coupled to the other unit;

the latch receiver and latch member being magnetically attracted such that when the units are brought together a magnetic force from the magnetic attraction causes the latch member to move in a direction transverse to the axis and be received by the latch receiver.

In an embodiment, the latching member is elongate along the axis. The latching member may comprise one of a bar, rod, cylinder or pin, for example.

In a fourth aspect, the invention provides a latch for a swinging barrier, the latch comprising:

first and second units adapted for mounting respectively on the swinging barrier and an adjacent structure;

a latch member associated with one of the units and a latch receiver associated with the other unit configured to receive the latch member;

a lever arm coupled to one of the latch member and latch receiver and arranged to release the latch from the latch receiver;

one of the units having a wing extending outwardly, the wing having a thumb receiving portion;

the latch being configured so that a thumb of a hand is placed on the thumb receiving portion and at least one finger of the hand placed behind the lever arm.

Embodiments of any one of the second to fourth aspects of the invention may take on any one of the features described with reference to the first aspect of the invention.

In a fifth aspect, the invention provides a lock adaptor comprising:

a casing having an inner and outer surface, the inner surface being configured to receive a lock, and the outer surface being similarly configured to an outer surface of another lock.

In an embodiment, the casing has an open and a closed configuration. The open configuration may expose the inner surface. The open configuration may be for receiving the lock and the closed configuration may be for retaining the lock so received. The casing may comprise two halves connected at a hinge. The hinge may be integral with the two halves. The casing may open around the hinge.

In an embodiment, at least one of the halves has a planer extension segment extending outwardly. Both of the halves may have a respective planar extension segment extending outwardly. The segments may be adjacently located when the casing is closed. The segments may abut when the casing is closed.

In an embodiment, the halves may be configured to secure together when the casing is closed.

In an embodiment, the lock adaptor comprises a lock adaptor rotor configured to engage the lock and transmit a rotation on operation of the lock. The lock rotor may have a flat tip at an end. A shank may be located at an opposing end. The shank may be configured to engage the lock.

In an embodiment, the inner surface has a cut-away region extending circumferentially and configured to house the shank. The cut away region may penetrate the casing.

BRIEF DESCRIPTION OF THE FIGURES

In order to achieve a better understanding of the nature of the present invention embodiments will now be described, by way of example only, with reference to the accompanying figures in which.

DETAILED DESCRIPTION OF EMBODIMENTS OF THE INVENTION

Figure 1:
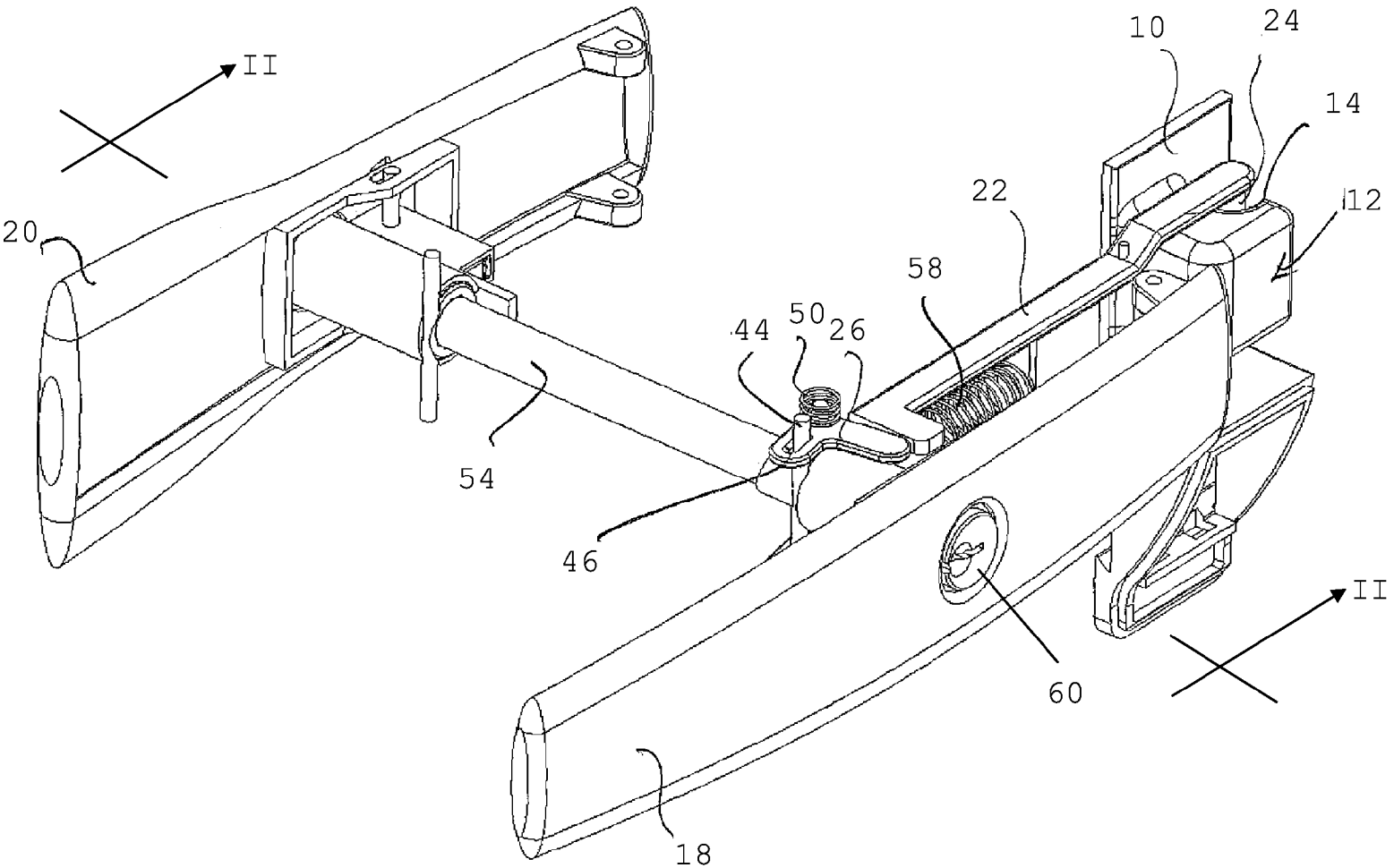
FIG. 1 is an isometric view of some components of an embodiment of a latch in accordance with one aspect of the invention.
Figure 2:
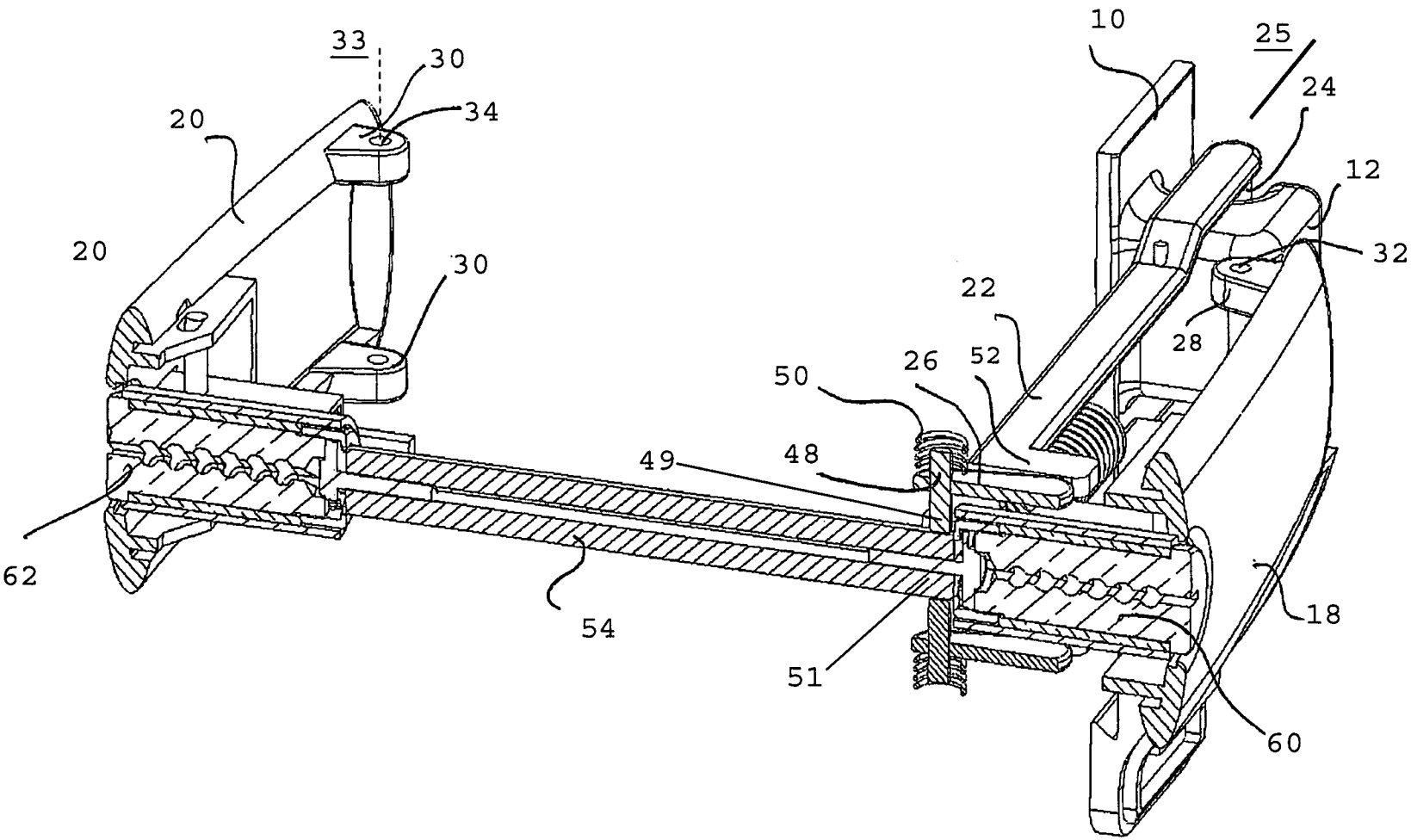
FIG. 2 is an isometric part sectional view taken along the axis of the actuating mechanism i.e. along the line II-II of FIG. 1.
Figure 3:
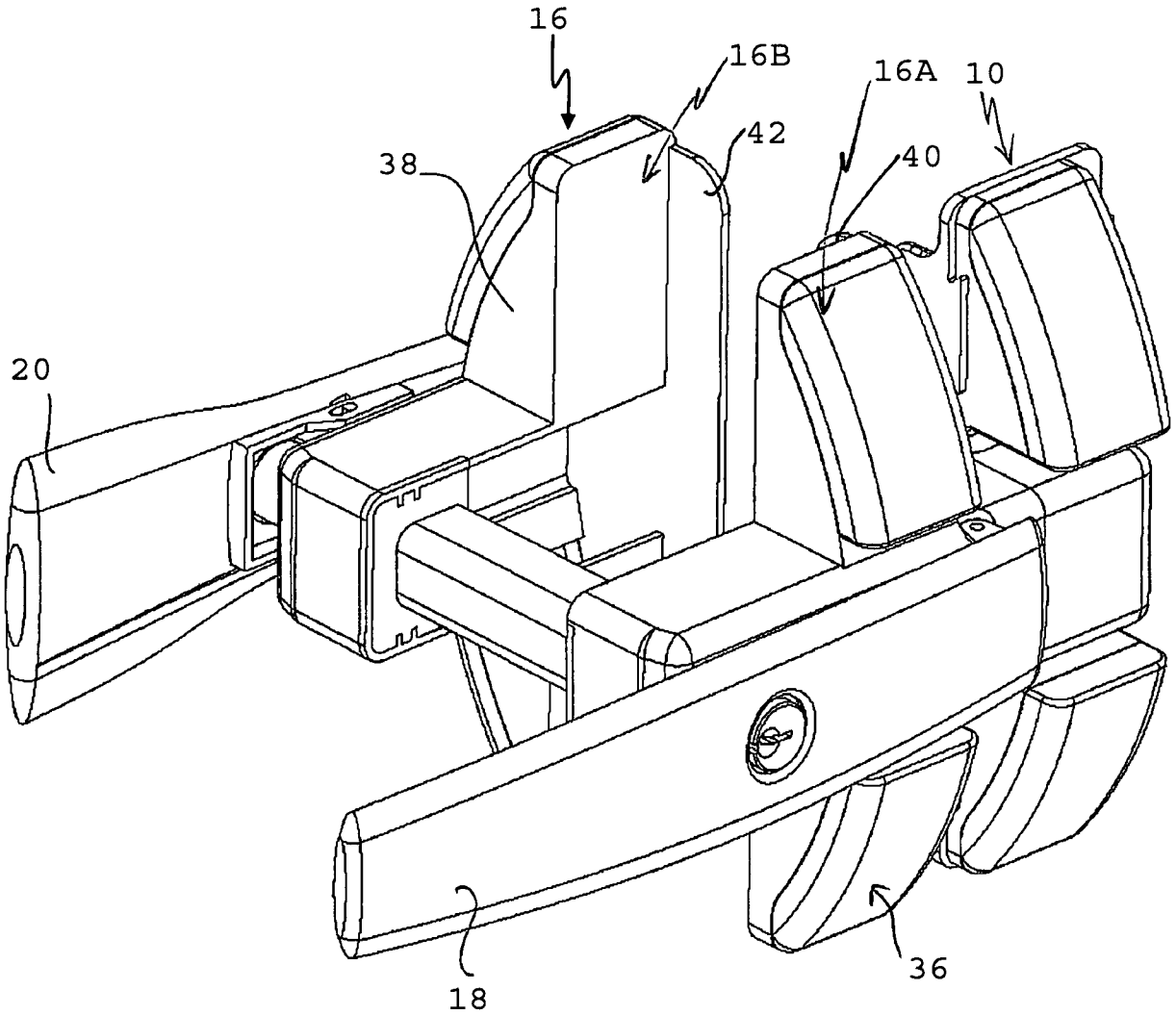
FIG. 3 is an isometric view of the embodiment of FIG. 1 in an overall assembled form.
Figure 4:
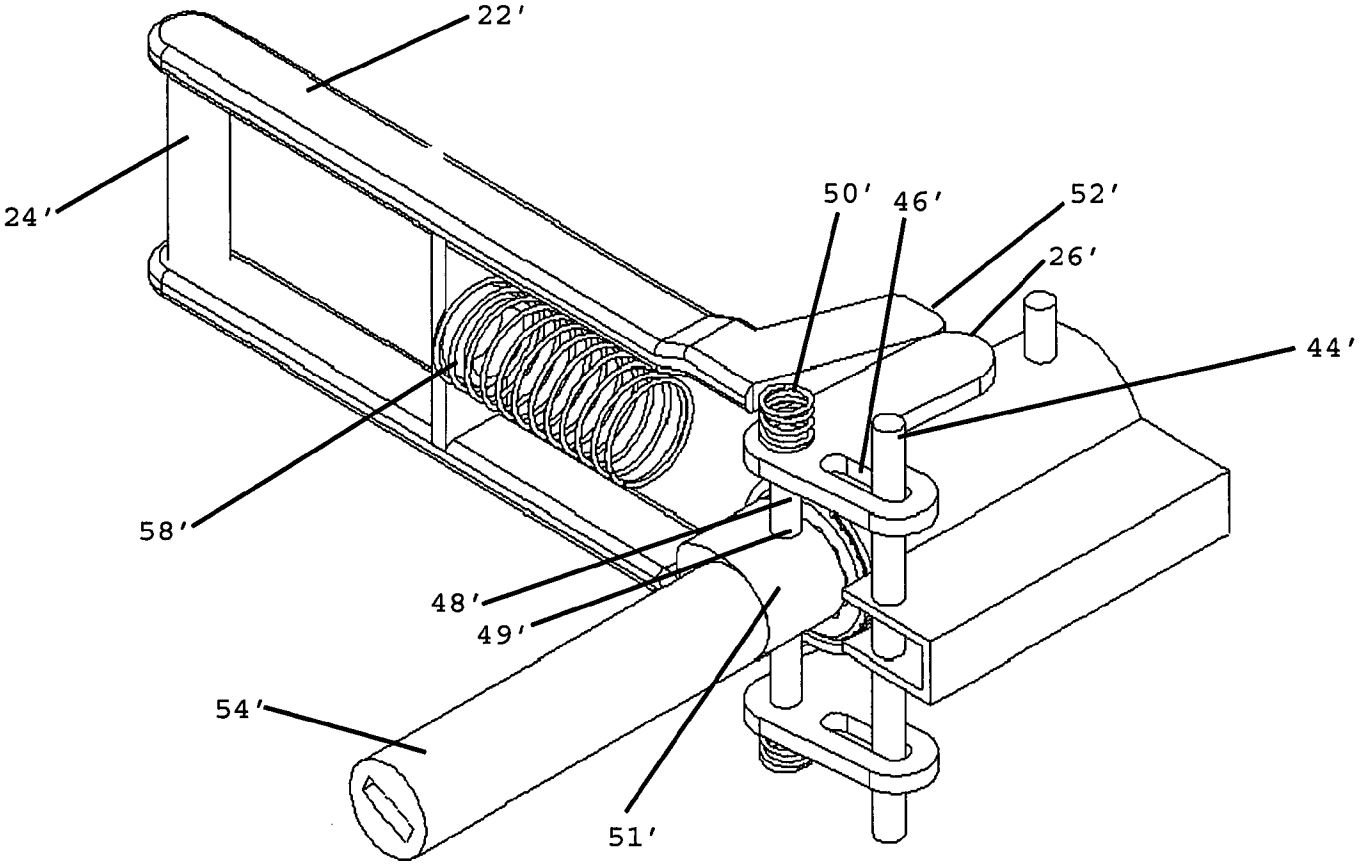
FIG. 4 is an isometric rear view of an example mechanism similar to that used in the latch shown in FIG. 1, in an unlocked configuration.

The embodiment of a latch shown in FIGS. 1 to 3 comprises a first unit 10 adapted to be mounted on a structure such as a gate post or door jamb and including a fixed latch receiver 12 having a latch shoulder 14, and a second unit 16 adapted to be mounted on a swinging barrier such as a door or gate and, as shown in FIG. 3, comprising a front unit 16A and a rear unit 16B which have respectively a lever arm in the form of a pull handle 18 and another lever arm in the form of a push bar 20 for actuating a latch mechanism. The lever arms are a form of human-mechanism interface. FIG. 4 shows a rear view of a latch mechanism of another but similar embodiment of a latch to that shown in FIGS. 1 to 3. Component parts in FIG. 4 which are similar to component parts in FIGS. 1 to 3 are similarly numbered. The latch mechanism comprises a mounting arm in the form of a slideable yoke 22 having a latch member 24 adapted to engage behind the latch shoulder 14. The latch has a linkage in the form of a bell crank 26 adapted to be rotated by either the pull handle 18 or the push bar 20. Of course the bell crank could be adapted to be rotated by some other human-mechanism interface such as a button and/or pull cord, for example.

As can most clearly be seen in FIG. 2, the pull handle 18 and push bar 20 have respective end lugs 28 and 30 for mounting pivotally on pivot axles (not shown) to be engaged in respective bores 32 and 34. The pull handle and push handle may pivot around an axis, such as 33, through bores 32 and 34 respectively. The pivotal mounting is provided for in respective housings 36 and 38, the housing having transverse end plates 40 and 42 adapted to receive end fixing screws (not shown) which can go into, for example, the end face of the gate such as a square tube.

The bell crank 26 is pivotally mounted on a pivot pin 44 which engages an elongated slot 46 in the bell crank. The bell crank is itself pivotally mounted on one end of a pin 48. A helical biasing spring 50 urges the bell crank downwardly to the position shown in the drawing so it is aligned with a foot 52 forming the end of the yoke 22. The other end of the pin 49 abuts a rotatable cam 51 (best seen in FIG. 4) and the pin is displaced along its axis by the surface of the cam when the cam 51 is rotated. The front and rear units are interconnected by a linkage in the form of a tubular shaft 54 (on which the cam 51 is mounted) so that when the handle 18 is pulled or the push bar 20 is pushed, the shaft 54 displaces the pin 48 along an arcuate path and that in turn rotates the bell crank anti-clockwise (as seen in the drawings 1 and 2) so that its tip engages the foot 52 to displace the yoke in a rectilinear manner, along a displacement axis indicated by 25, to unlatch (or release) the latch member 24 from the latch shoulder 14, whereby the latch is opened and the gate can be moved to an opened position.

In the embodiment of FIG. 1, the latch member is of a ferro-magnetic material, in this example steel, and the latch receiver 12 incorporates a permanent magnet (not shown in the drawings) arranged to attract the latch member into the latch receiver by a force substantially exceeding the spring biasing from helical spring 58 which urges the yoke towards the open position. The magnet in this example is a rare earth magnet. When the latch has been unlatched and the gate is opened, then the bias spring 58 retains the yoke in a displaced position so that on re-closure of the gate there is no mechanical resistance to the latching position being adopted. The magnetic force attracts the latch member 24 into the latch to achieve latching again.

Figure 5:
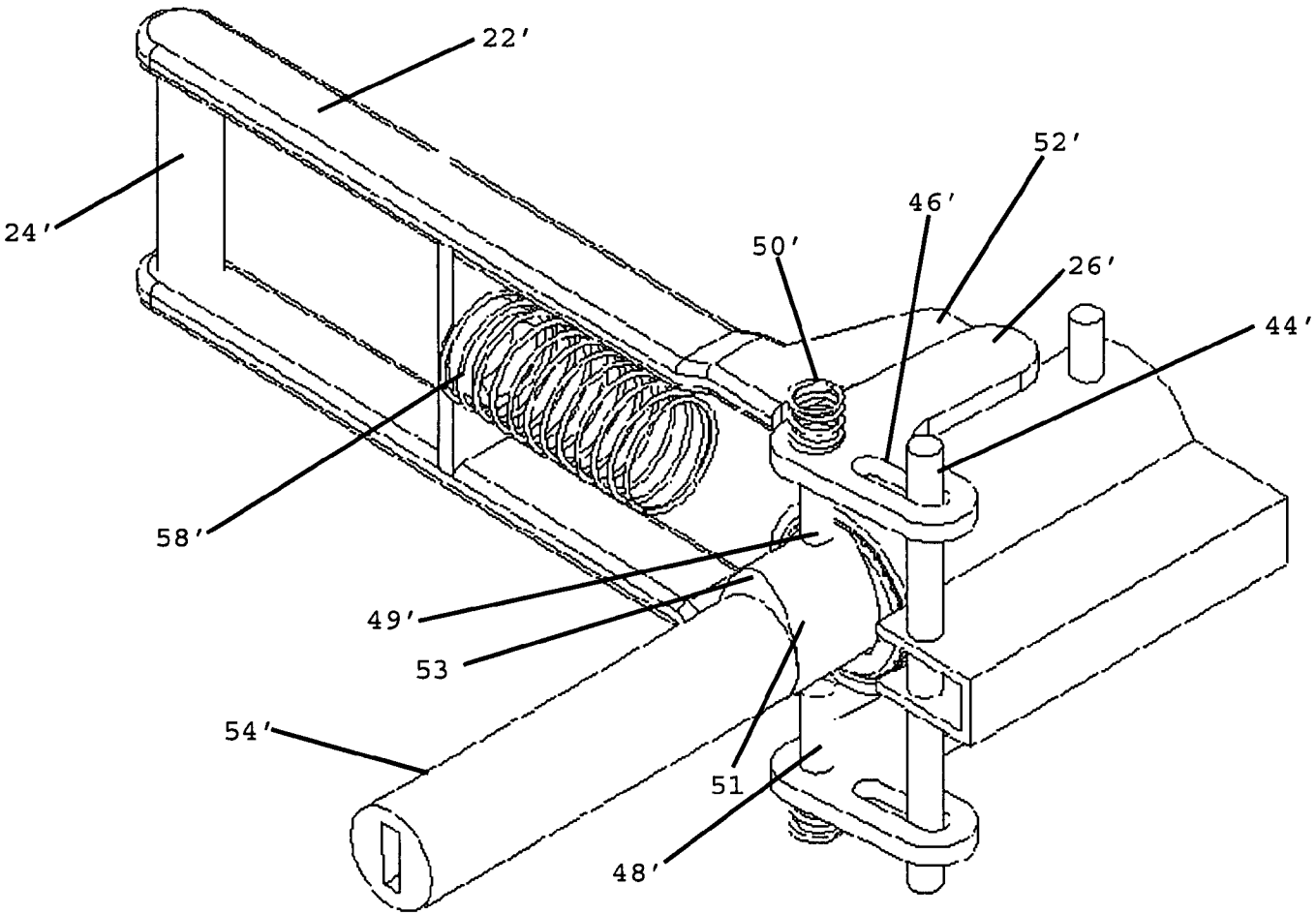
FIG. 5 shows the mechanism of FIG. 4 in a locked configuration.

In the embodiment shown in FIGS. 1 to 3, each of the front and rear units incorporates a lock 60, 62. When either lock is rotated to the locked position, a lifting element, in this case comprising the cam 51 and pin 48, operates to displace the bell crank 26 upwardly against spring biasing so that it is located above the level of the yoke and any operation of the pull handle 18 or push bar 20 has no effect as there is no force applied to the yoke 22 and no unlatching occurs. This locked configuration is illustrated in FIG. 5; the end of the pin 49' is resting on an apex 53 of the cam 51. As both the pull handle 18 and push bar 20 may move there is less opportunity for damaging the linkage as there is simply free movement.

Figure 6:
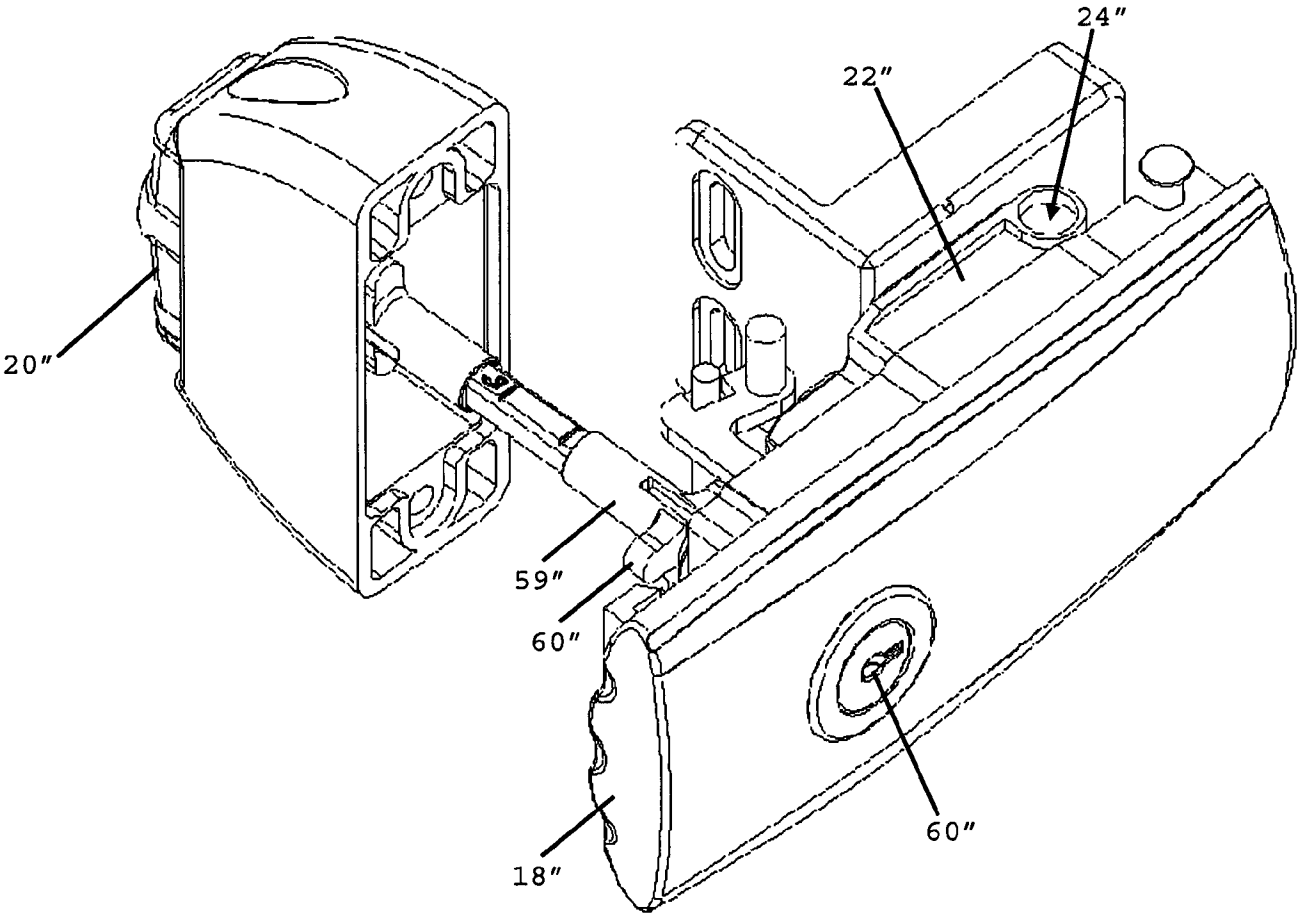
FIG. 6 shows an isometric view of another embodiment of a latch.
Figure 7:
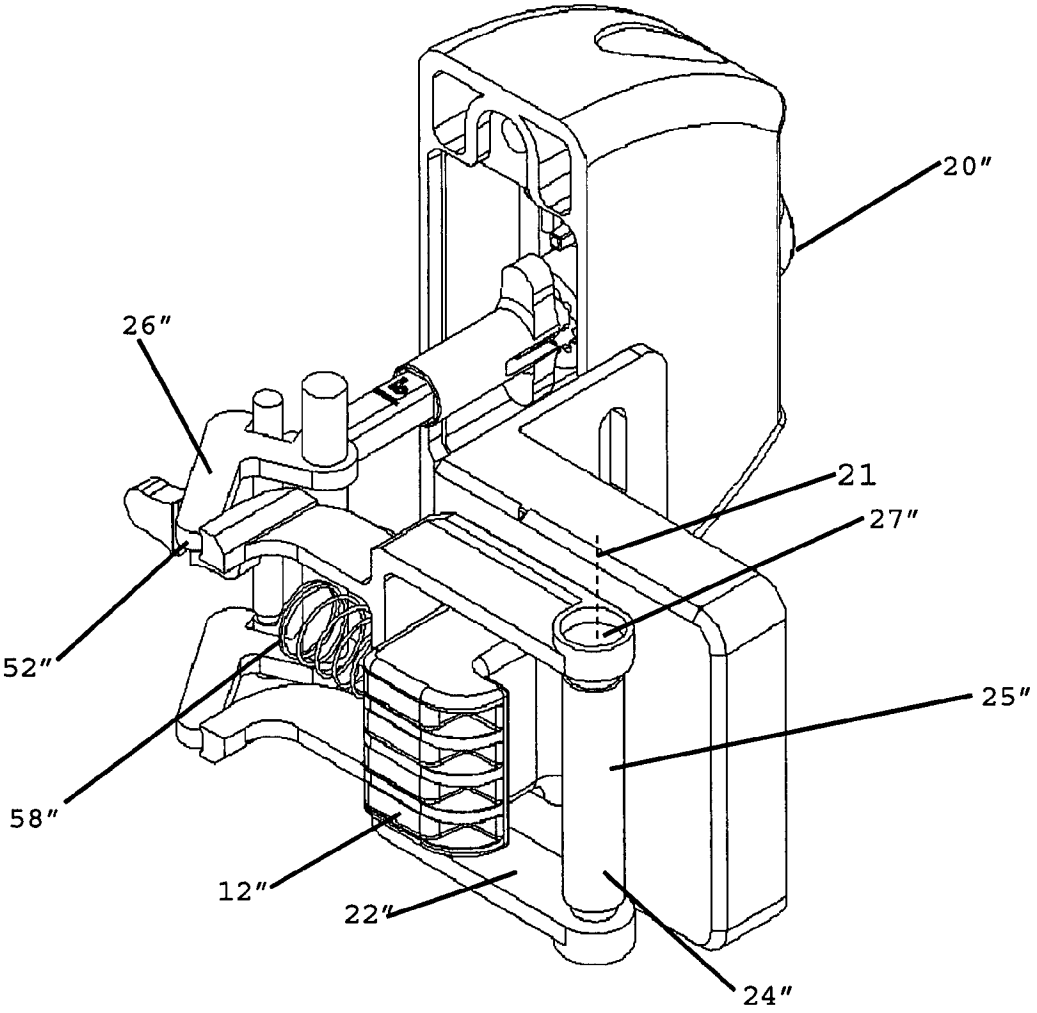
FIG. 7 shows another isometric view of the latch shown in FIG. 6 with a lever arm removed to reveal a mechanism.

FIG. 6 shows another embodiment of a latch and some of its component parts are shown in isolation in FIG. 7. Component parts similar to those shown in FIGS. 1 to 5 are similarly numbered. In this example, the mechanism may also be operated by the pressing of a button 20" as well as a push bar 18". The latch member 24", best seen in FIG. 7, in this example, comprises a bearing in the form of a metal sleeve 25" located around an axle 27", each end of which engage the yoke 22". The sleeve and axle are configured so that the sleeve can rotate freely around the axle. This reduces the resistance experienced between the latch member 24" and the latch receiver 12" facilitating a smooth and trouble free operation. The latching member 24" has an axis indicated by the dashed line 21, and is elongate along the axis.

Figure 8:
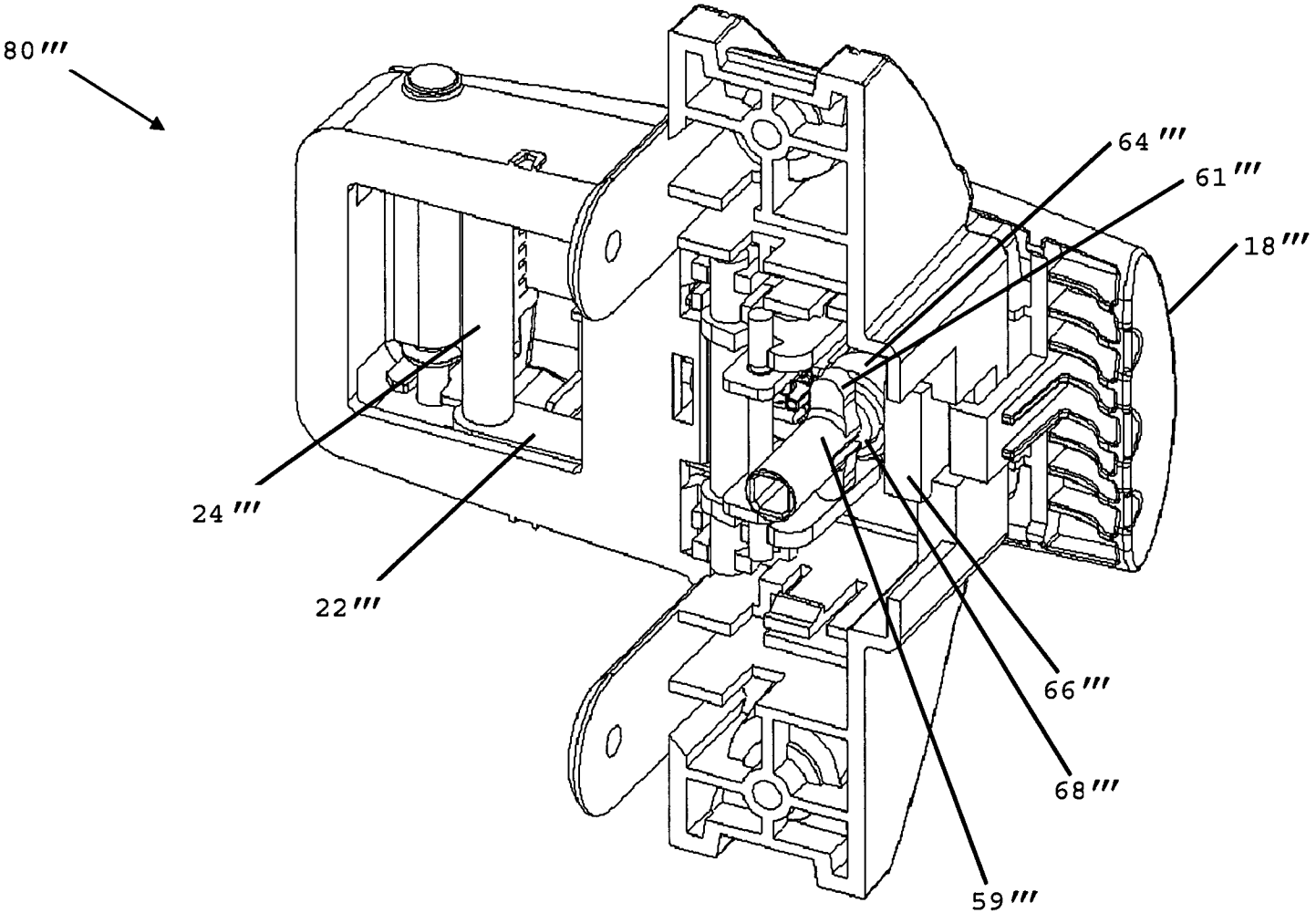
FIGS. 8 and 9 are isometric rear views of another embodiment of a latch, the latch being in unlocked and locked configurations respectively.
Figure 9:
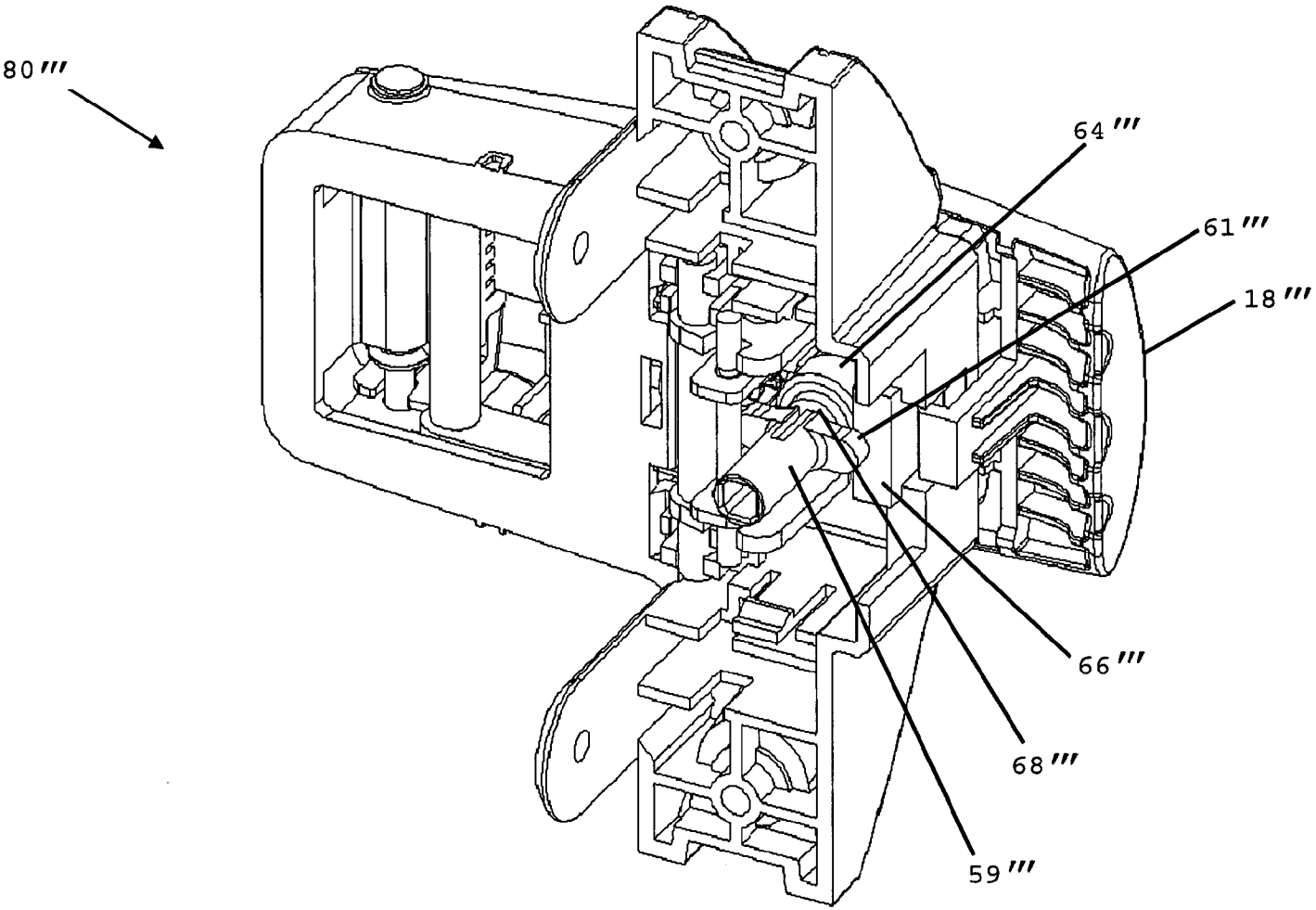

FIGS. 8 and 9 show a rear view of another embodiment of a latch. In this embodiment, the latch is not locked or unlocked by displacing the linkage as described in relation to FIGS. 1 to 5. In this embodiment, a rotor 59''' having a rotor arm 61''' may be rotated by operating the lock 60''' on the pull bar mechanism (seen in FIG. 6).

In the unlocked configuration, shown in FIG. 8, when the pull handle 18''' is pulled (or a push button pushed), that is the pull handle moved into the page as seen in FIG. 8, the rotor arm is in a rotational position so that it is free to move into a rotor arm cavity 64''' and the mechanism is operated unlatching the latch. In the locked configuration, shown in FIG. 9, the rotor arm is in another rotational position relative to the unlocked configuration. The rotor arm is rotated by 90°, at least in this embodiment. Movement of the rotor arm, into the page, is blocked by an interfering member in the form of a rotor shoulder 66'''. When in the other rotational position the rotor arm can not move into the rotor cavity 64'''. Because there is a coupling in the form of a rigid rod or bar 68 between the rotor arm and the pull handle 18", the pull handle is prevented from moving outwards by abutment of the rotor arm 60" on the rotor shoulder 66".

Figure 10:
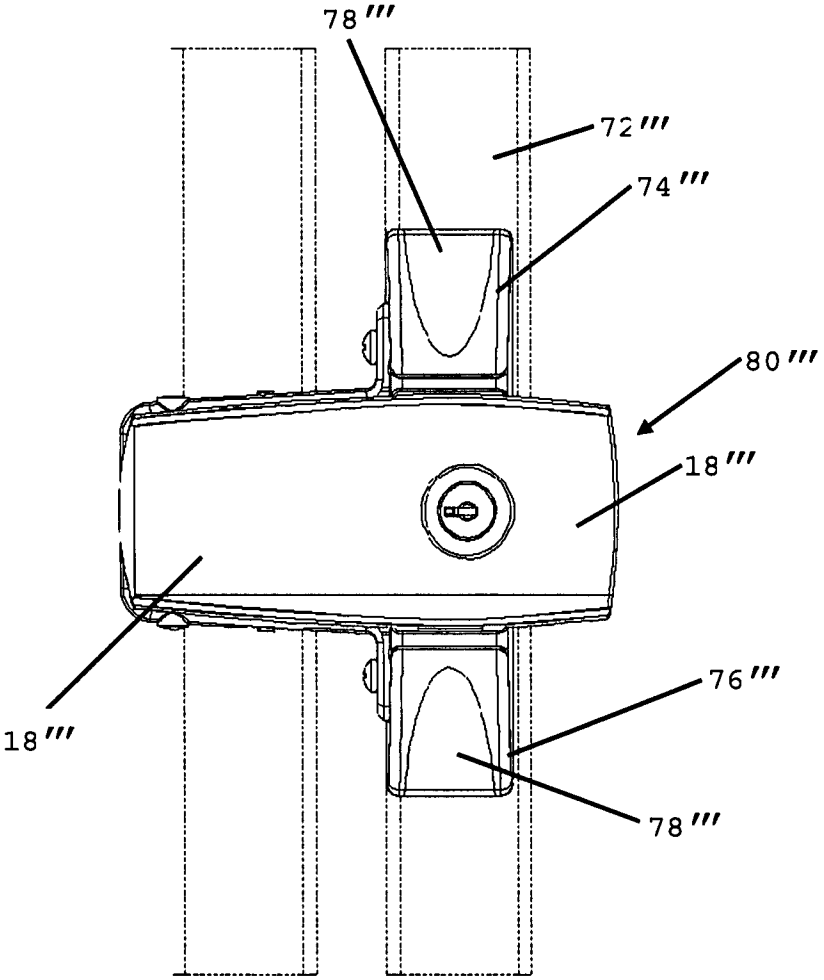
FIG. 10 shows a front view of the latch in FIGS. 8 and 9.
Figure 11:
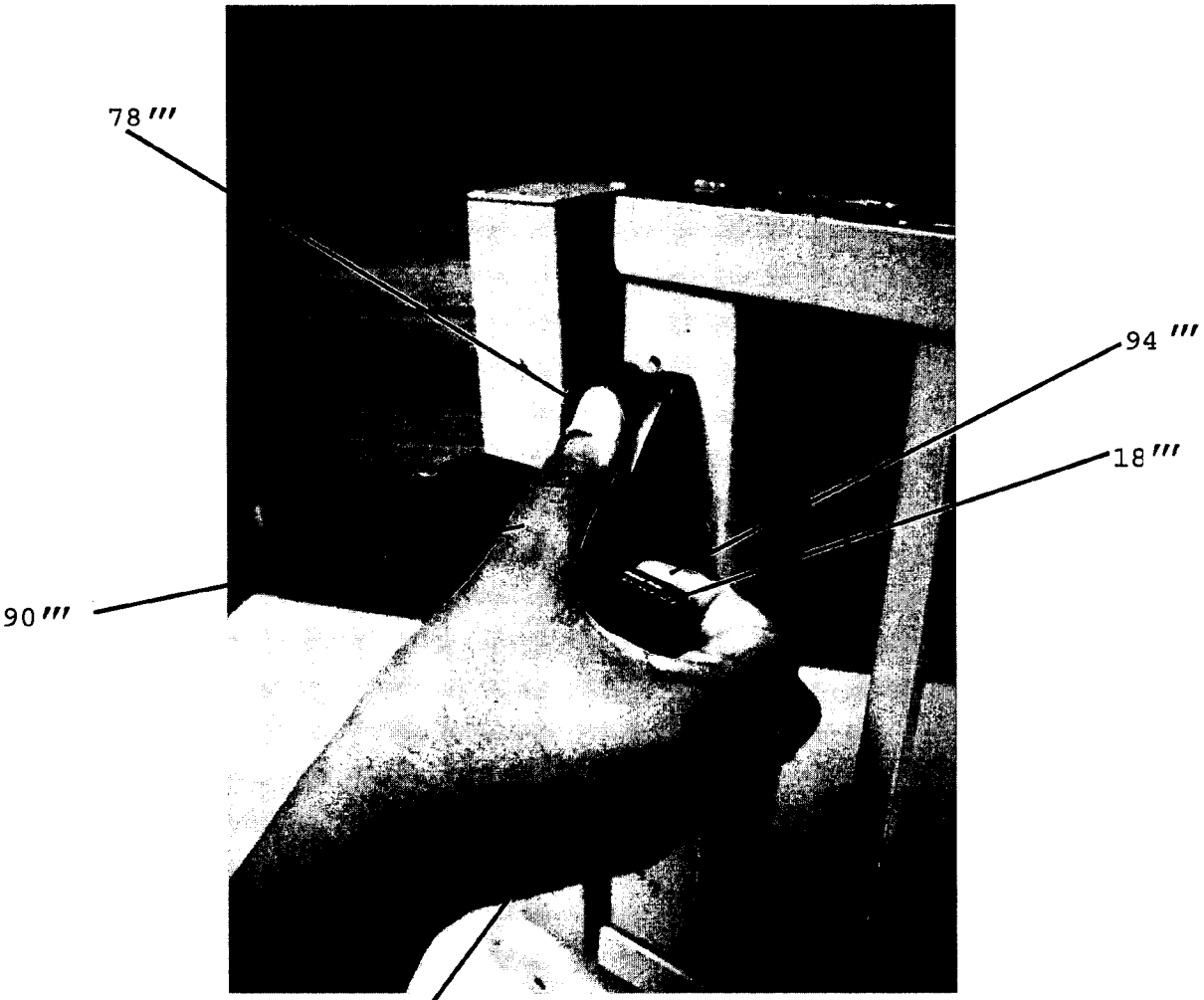
FIG. 11 shows the latch of FIGS. 8 to 10 being opened with a thumb located on a wing.

FIG. 10 shows a front view of the latch shown in FIGS. 8 and 9 and is generally indicated by the numeral 80'''. The second unit of the latch 80''' is mounted to a gate 72'''. The second unit has a pair of wings 74''',76''' extending away from the pull-arm 18'''. The pull-arm can move relative to the wings 74",76", in this example out of the page. The wings each have a respective thumb receiving portion 78''', in this embodiment, in the form of a depression bordered by a section of a paraboloid adapted to receive a thumb of a person operating the latch as shown in FIG. 11. In use, a thumb 90''' of a hand 92''' is located in the depression 78''' and at least one finger 94''' of the same hand placed under the pull arm 18'''. Opposing forces generated by the hand and acting respectively on the thumb receiving portion and the pull handle 18''' causes displacement of the pull handle 18''' opening the latch. It will be appreciated that this opening mechanism is ergonomic and consequently the latch may be easier to operate than other latches. Wings on both sides enable the unit to be turned upside down if the barrier opens at the other side.

Figure 12:
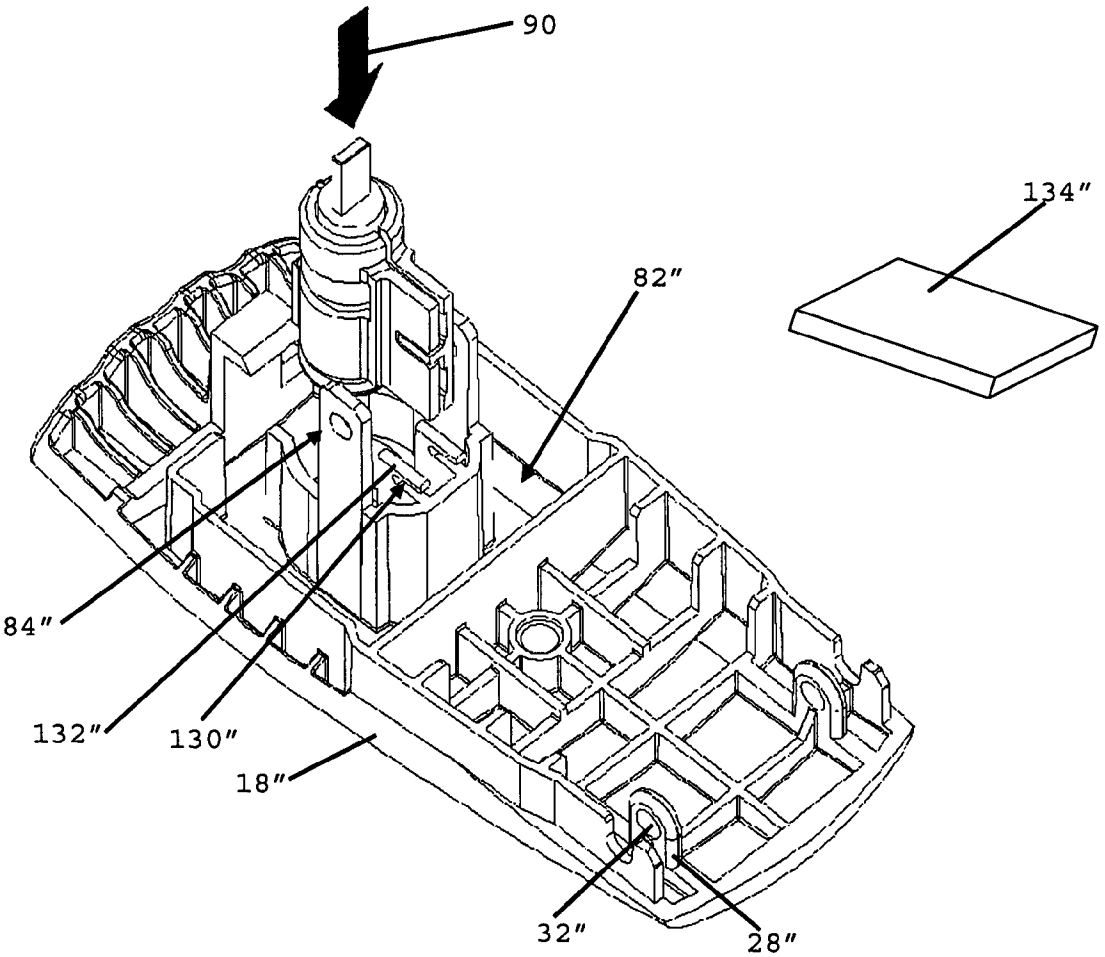
FIG. 12 is an isometric rear view of a lever arm which is configured to receive an illustrated lock.
Figure 13:
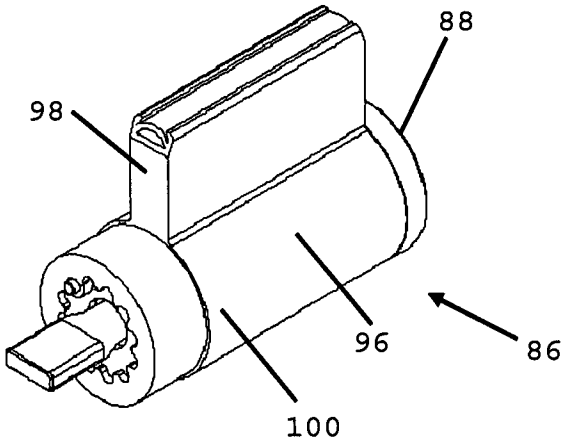
FIG. 13 shows a prior art cylinder lock suitable to be received by the lever arm shown in FIG. 12.

FIG. 12 shows a rear view of the lever arm 18" shown in FIG. 6. The rear face 82" of the lever arm 18" defines a recess 84" configured to receive a cylinder lock, an example of which is shown in FIG. 13 and generally indicated by the numeral 86. The cylinder lock 86 is inserted keyhole end 88 first in the receptacle 84" and is retained in place by, at least in this embodiment, snap locks. In another embodiment, a retaining piece 134" is inserted in the slots such as 130" under pins such as 132". The arrow 90 in FIG. 12 indicates the direction of insertion.

Figure 16:
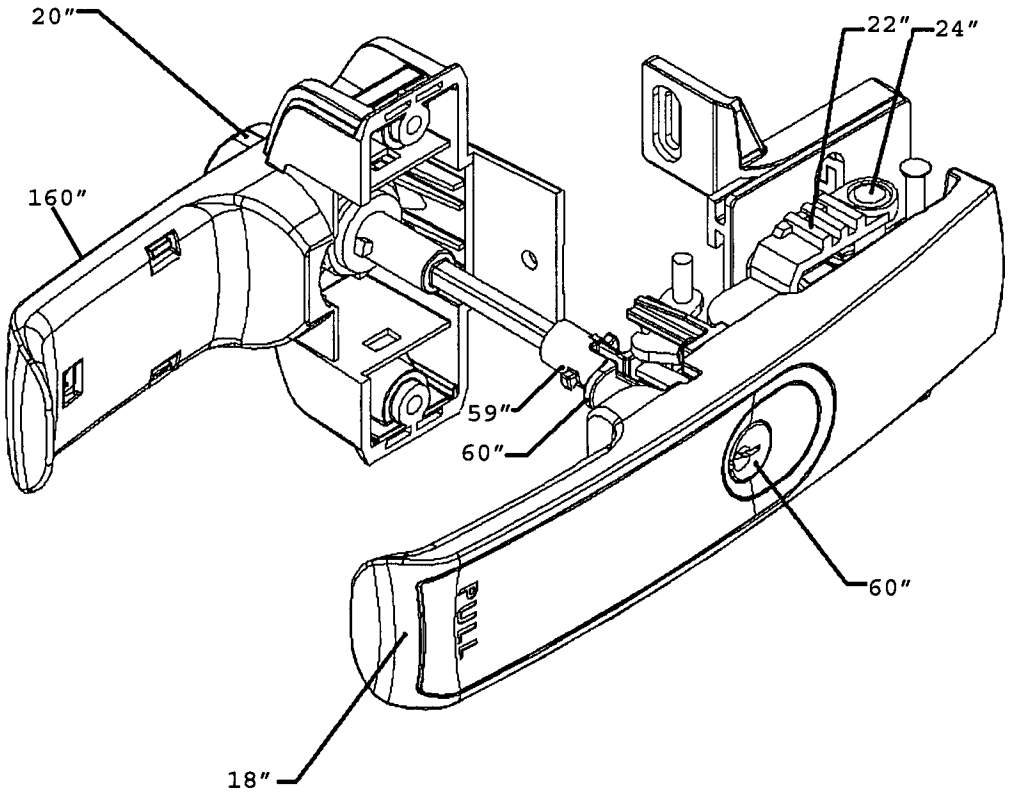
FIG. 16 shows an isometric view of another embodiment of a latch.
Figure 17:
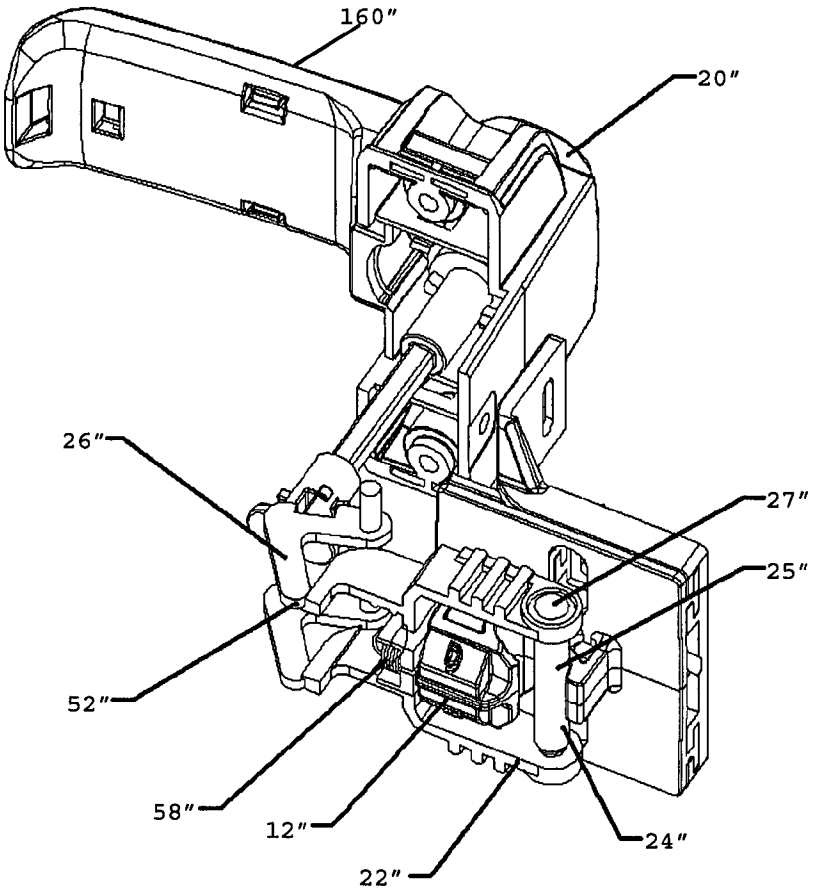
FIG. 17 shows another isometric view of the latch shown in FIG. 16 with a lever arm removed to reveal a mechanism.

FIG. 16 shows an isometric view of another embodiment of a latch, with parts similar to those in FIG. 6 similarly numbered. In this embodiment, however, bar 18" is pulled to operate the mechanism. One the other side of the latch, a handle 160" can be grasped and a button 20" pressed with a thumb, for example, to operate the mechanism. FIG. 17 shows another isometric view of the latch shown in FIG. 16 with a lever arm removed to reveal the mechanism.

Figure 18:
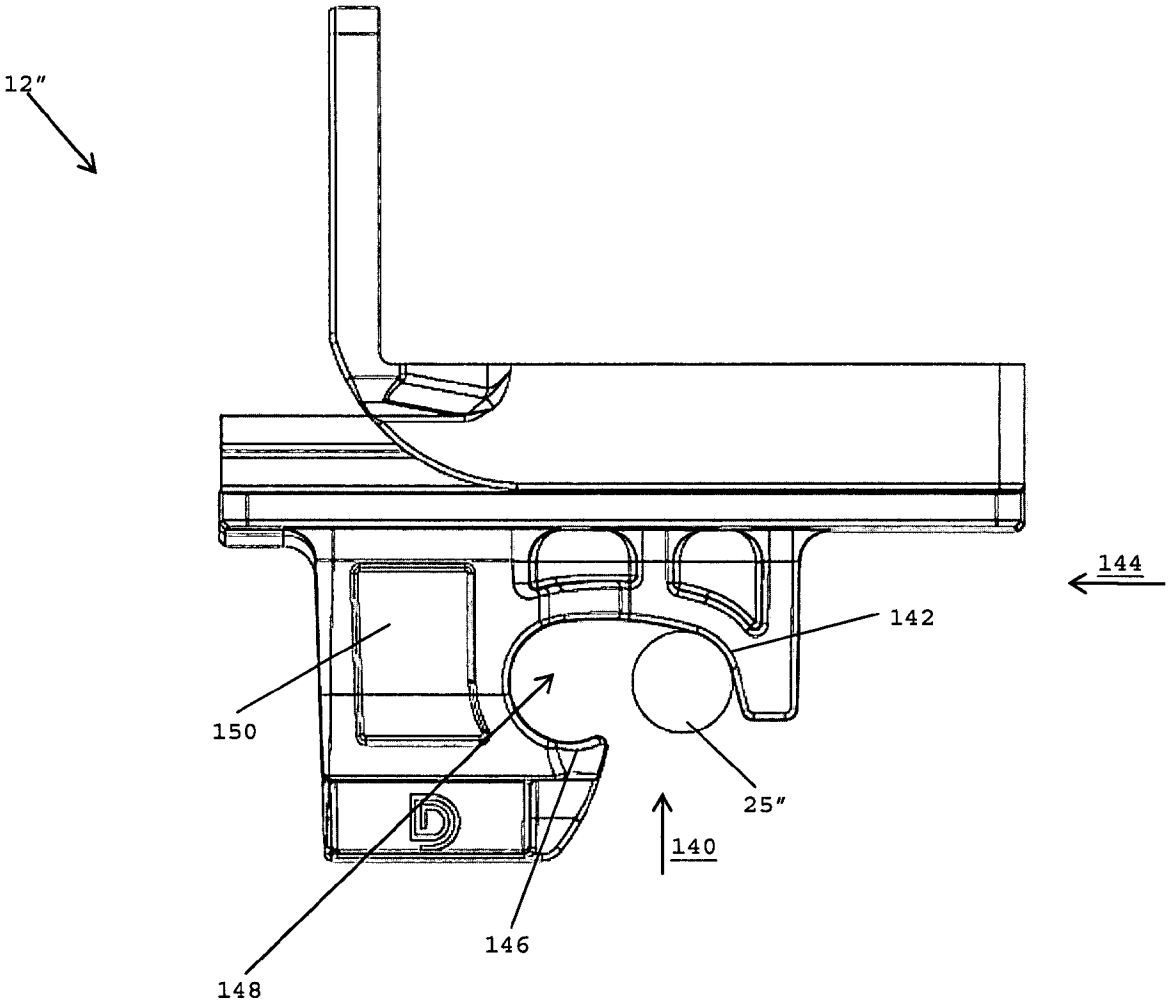
FIG. 18 shows a top view of a latch receiver of the latch of FIG. 17.

FIG. 18 shows a top view of the latch receiver 12" shown in FIG. 17. On closing of the gate, the metal sleeve 25" of the latch member has moved in a first direction 140 into contact with a directing surface 142 configured to move the latch member in an second direction when so contacted. The second direction 144 is, in this embodiment at least, orthogonal to the first direction. The latch member then moves in the second direction to a position 148 behind a latch shoulder 146. The movement of the gate is thus converted to movement of the latch member towards the position 148. This assists the magnet concealed in the body 150 of the receiver to pull the latch member into the position 148.

Figure 19:
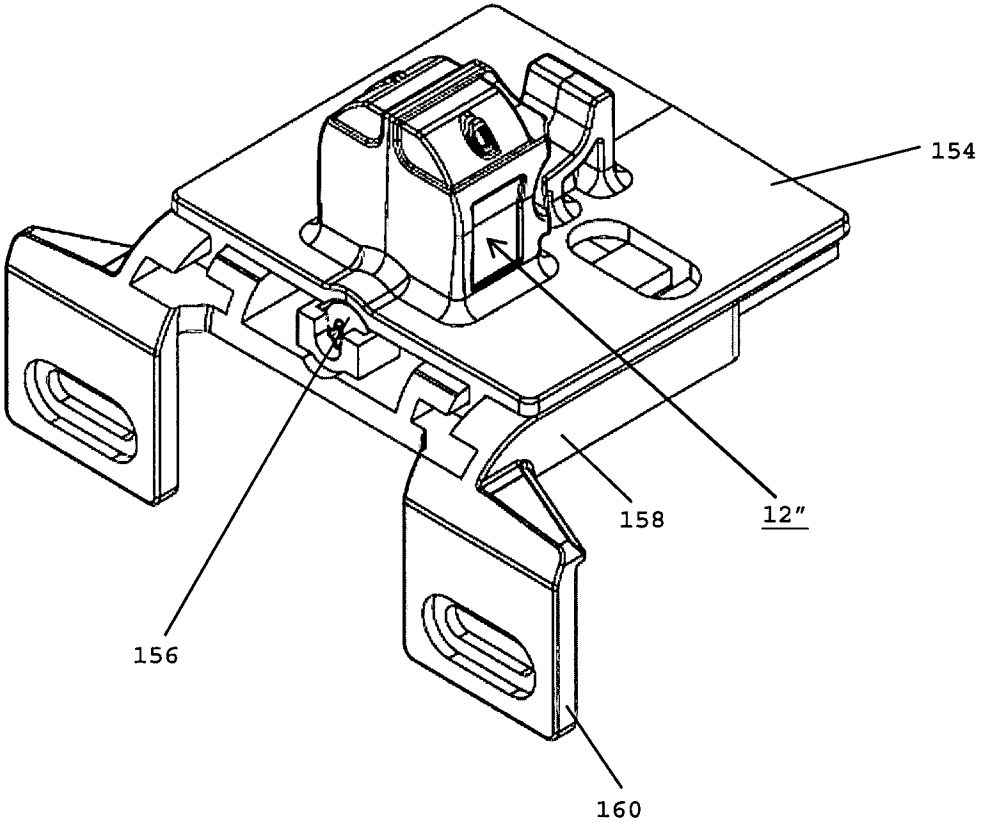
FIGS. 19 and 20 show the latch receiver of FIG. 18 mounted on a translatable stage, in respective first and second translated positions.
Figure 20:
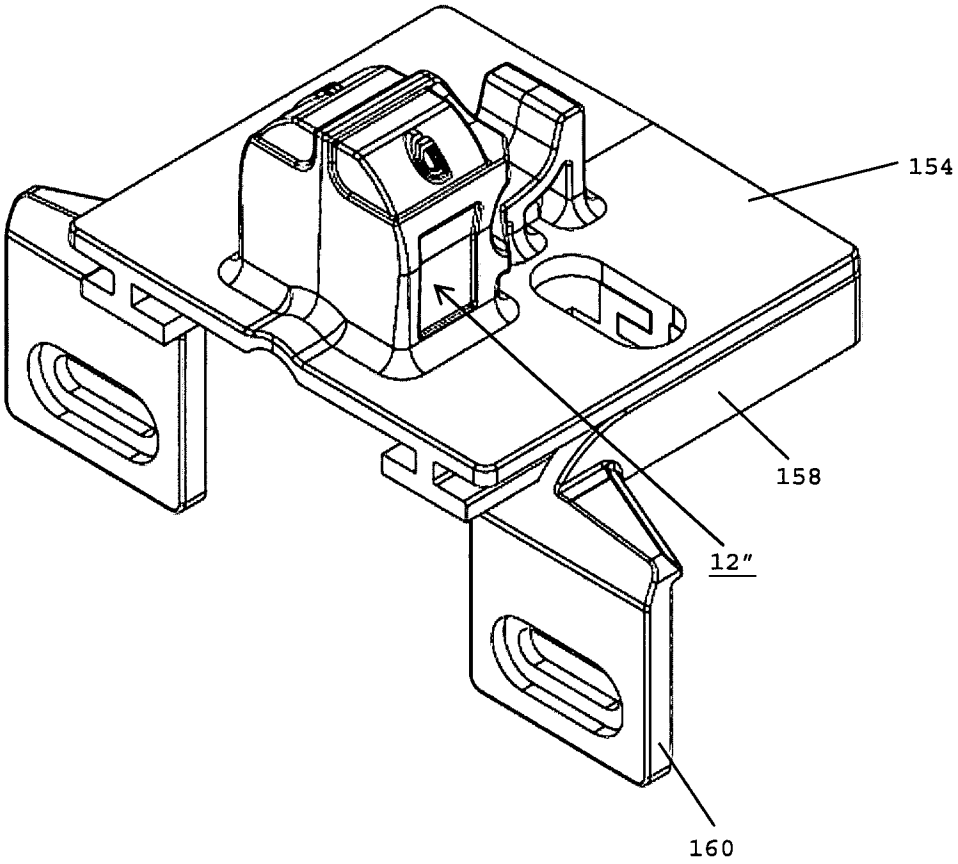

FIGS. 19 and 20 show the latch receiver 12" of FIG. 18 mounted on a translatable stage 154, in respective first and second translated positions. The stage is translated by turning an adjustments screw 156 with, for example, a screwdriver. The stage slides in rails 158 which are connected to at least one flange 160 for attachment of the latch receiver to the remainder of the latch.

Figure 21:
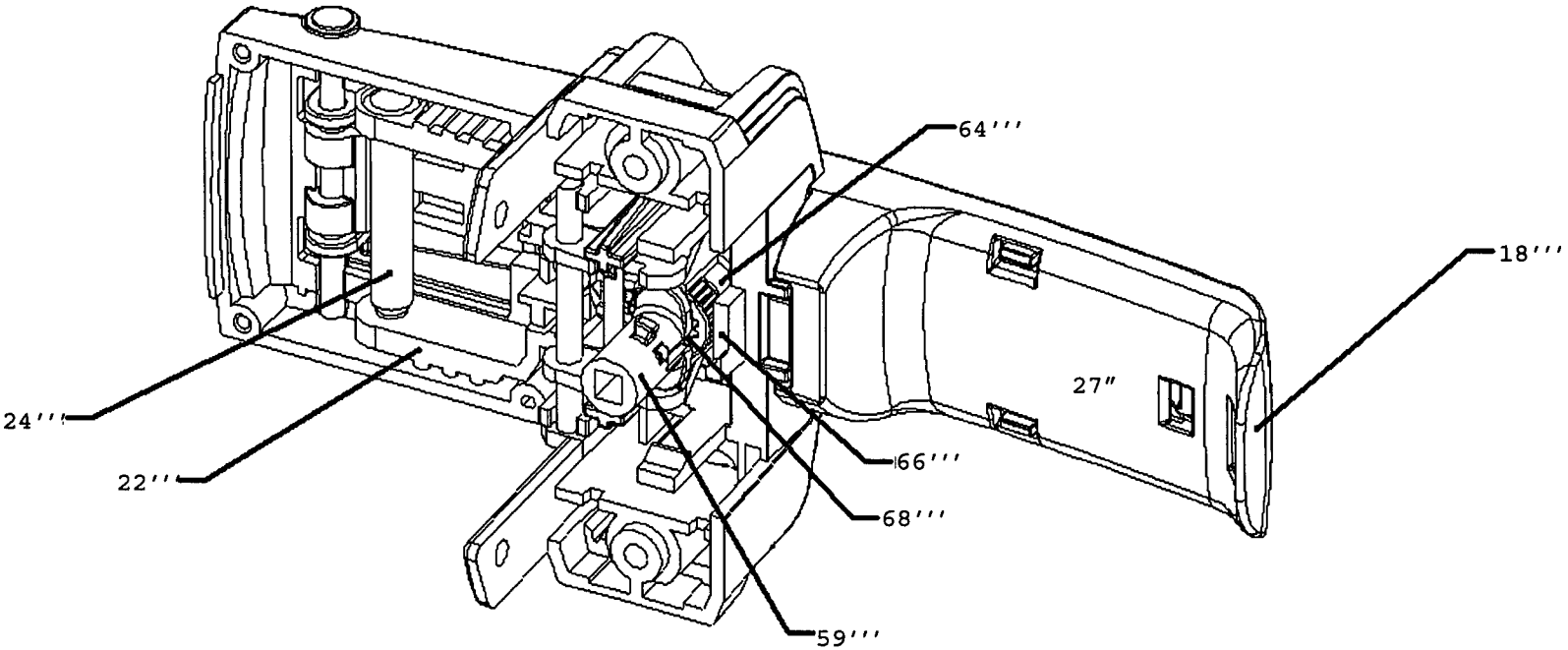
FIGS. 21 and 22 are isometric rear views of another embodiment of a latch, the latch being in unlocked and locked configurations respectively.
Figure 22:
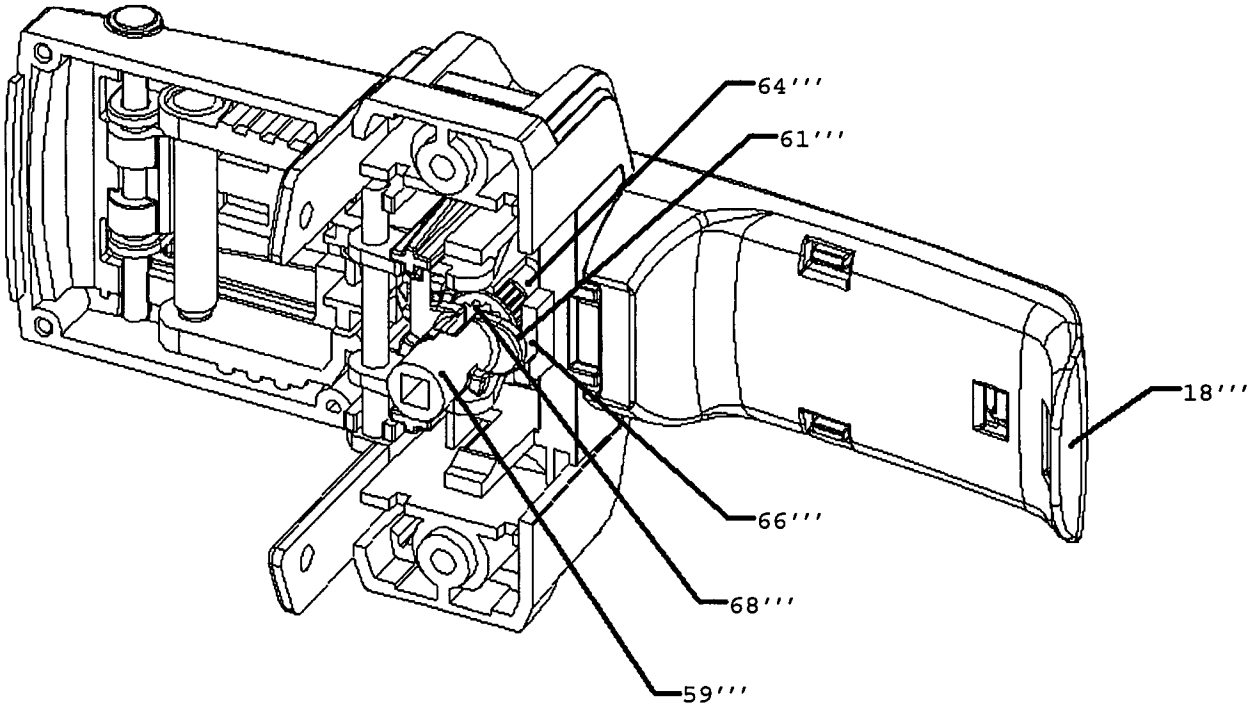

FIGS. 21 and 22 are isometric rear views of another embodiment of a latch, the latch being in unlocked and locked configurations respectively, with parts similar to those in FIGS. 18 and 19 similarly numbered.

Figure 14:
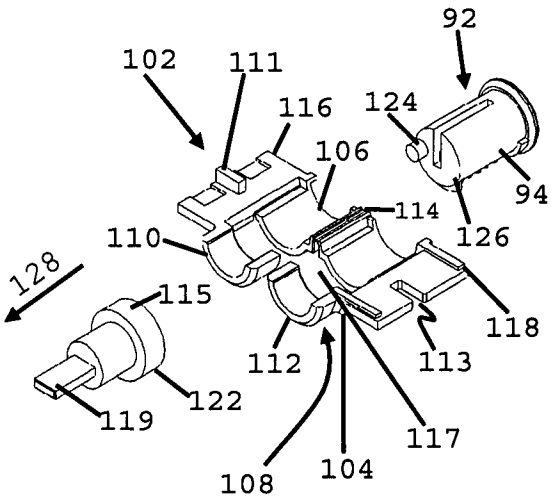
FIG. 14 shows an isometric exploded view of a lock adaptor for receiving a wafer lock in accordance with another aspect of the invention, the lock adaptor being in an open configuration.
Figure 15:
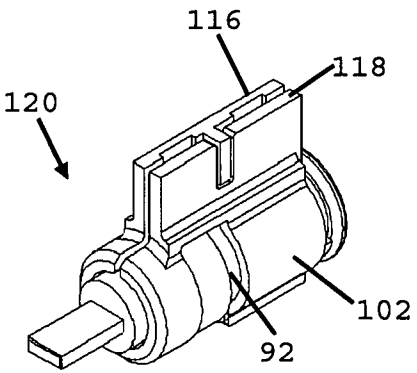
FIG. 15 shows an isometric view of the wafer lock of FIG. 14 retained in the lock adaptor of FIG. 14 in a closed configuration.

Cylinder locks, such as 6 and 5 pins cylinder locks, are high quality and secure locks. However, they are not necessarily in every situation. In some circumstances, a cheaper lock such as the wafer lock 92, as shown FIG. 14, is sufficient. The receptacle 84" is not, at least in this embodiment, configured to receive the wafer lock. It can be seen that the outer surface 94 of the wafer lock 92 has a different configuration than the outer surface 96 of the cylinder lock 86 and is a different size. In particular, the wafer lock is missing a planer extension segment 98 extending outwardly from the body 100 of the cylinder lock 86 and is of a smaller diameter. A wafer lock 92 can be inserted into the lever arm in FIG. 12 instead of a cylinder lock 86 through the use of a lock adaptor, one embodiment of which is shown in FIG. 14 and generally indicated by the numeral 102. The lock adaptor 102 has a casing 104 having an inner surface 106 and an outer surface 108. The inner surface 106 is configured to receive a wafer lock and the outer surface 108 is similarly configured to the outer surface 96 of a cylinder lock 86. The casing can be opened or closed around a hinge 114. In FIG. 14, the casing 102 is shown in an open configuration ready for receiving the wafer lock 92. The casing 102 comprises two halves 110 and 112 connected by the hinge 114. The hinge, at least in this embodiment, is integral with the two halves. The casing may be formed by injection molding of a polymer, for example, and the hinge and the two halves may constitute a single piece. Each of the halves 110, 112 have a respective planer extension segment 116 and 118 that extend outwardly from the casing 102. The segments are adjacently located and abut when the case is closed around the wafer lock 92 as shown in FIG. 15. The extension segments 116 and 118 when brought together have a thickness similar or identical to that of the extension portion 98 of a cylinder lock. Peg 111 is fitted snuggly in slot 113 to secure the casing in the closed configuration. Once the casing is closed around the cylinder lock 92 the assembly 120 can be inserted into the recess 84" at the back of the lever arm 18". The lock adaptor 102 also has a lock rotor 122 that engages a lug 124 extending from a back face 126 of the cylinder lock 94. When a key is inserted into the lock and turned the lug rotates and, as it is engaged with the lock rotor 122, causes the lock rotor 122 to rotate and thus transmit the rotation in direction 128. The lock rotor has a shank 115 which has a hole into which the lug 124 is inserted. The shank is located in a cut-away region 117 extending circumferentially. The rotor has a flat tip 119 for ready engagement.

It will be understood to persons skilled in the art of the invention that many modifications may be made without departing from the spirit and scope of the invention.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A latch for a swinging barrier, the latch comprising:

first and second units adapted for mounting respectively on the swinging barrier and an adjacent structure;

a latch member having an axis and opposite ends each of which engage a latch mounting arm coupled to one of the units;

a latch receiver coupled to the other unit;

the latch receiver and latch member being magnetically attracted such that when the units are brought together a magnetic force from the magnetic attraction causes the latch member to move in a direction transverse to the axis and be received by the latch receiver.

2. A latch defined by claim 1 comprising a lever arm mounted to pivot around another axis, the lever arm being coupled to a rotary to linear linkage arranged to displace a mounting arm on which one of the latch member and the latch receiver is mounted.

3. A latch defined by claim 2 wherein the mounting arm is biased in a direction and the linkage is arranged to displace the mounting arm in an opposite direction.

4. A latch defined by claim 2 further comprising a lock adapted to, when operated, decouple the linkage from the mounting arm.

5. A latch defined by claim 4 wherein the lock is coupled to a cam wherein operation of the lock causes the cam to rotate and lift the linkage out of alignment with the mounting arm.

6. A latch defined by claim 1 comprising a lock operationally coupled to a rotor, the rotor having a rotor arm that is rotated by operation of the lock, and the latch having an interfering member which blocks a movement of the rotor arm when the lock is in a locked position.

7. A latch defined by claim 1 wherein the latch member comprises a rotatable bearing.

8. A latch defined by claim 1 comprising a wing extending outwardly, the wing comprising a thumb receiving portion, the lever arm having an end adjacent the wing and extending perpendicularly to the wing, the latch being configured so that a thumb of a hand is placed on the thumb receiving portion and at least one finger of the hand placed behind the end of the lever arm.

9. A latch defined by claim 2 wherein lever arm is adapted to be pushed.

10. A latch defined by claim 2 wherein the lever arm is adapted to be pulled.

11. A latch defined by claim 1 wherein the magnetic force pulls the latch member towards the latch receiver.

12. A latch defined by claim 11 wherein one of the units has a first magnet and the other having an element magnetically attracted to the first magnet.

13. A latch defined by claim 12 wherein the latch receiver has the first magnet.

14. A latch defined by claim 13 wherein the element may have a second magnet orientated to be attracted to the first magnet.

15. A latch defined by claim 1 wherein the latch member is elongate along the axis.

16. A latch defined by claim 1 wherein the latch member comprises one of a bar, rod, cylinder or pin.

17. A latch for a swinging barrier, the latch comprising:

first and second units adapted for mounting respectively on the swinging barrier and an adjacent structure, one of the units having a first magnet and the other having an element magnetically attracted to the first magnet, such that when the first and second units are brought together a magnetic force from the magnetic attraction between the element and first magnet causes a relative displacement of a latch member associated with one of the units into a latch receiver associated with the other unit;

a biasing member arranged to bias at least one of the first magnet and the element away from the other with a force less than the magnetic force;

an actuator for displacing one of the first magnet and the element and comprising a lever arm mounted to pivot around an axis and arranged to cause displacement of one of the magnet and the element in a direction transverse to the axis, wherein the lever arm is coupled to a rotary to linear linkage arranged to displace a mounting arm on which one of the latch member and the latch receiver is mounted, and further comprising a lock adapted to, when operated, decouple the linkage from the mounting arm, wherein the lock is coupled to a cam wherein a operation of the lock causes the cam to rotate and lift the linkage arm out of alignment with the mounting arm.

18. A latch as defined by claim 17 wherein the displacement caused by the actuator moves the first magnet and the element relatively apart along the axis, and the lever arm is adapted to be moved by a hand in the direction transverse to the axis.

19. A latch defined by claim 17 wherein the actuator further comprises a push-button.

* * * * *